US007314202B2

(12) United States Patent
Everett et al.

(10) Patent No.: US 7,314,202 B2
(45) Date of Patent: Jan. 1, 2008

(54) SYSTEM FOR SUSPENDING DECORATIVE TREES

(76) Inventors: Franklin C. Everett, Flemmish Down, S. Bellevue Ave., Newport, RI (US) 02840; Russell H. Everett, 281 Succotash Rd., Wakefield, RI (US) 02879

( * ) Notice: Subject to any disclaimer, the term of this patent is extended or adjusted under 35 U.S.C. 154(b) by 6 days.

(21) Appl. No.: 11/276,264

(22) Filed: Feb. 21, 2006

(65) Prior Publication Data

US 2006/0186300 A1 Aug. 24, 2006

Related U.S. Application Data

(60) Provisional application No. 60/655,056, filed on Feb. 22, 2005.

(51) Int. Cl.
*A47H 1/10* (2006.01)

(52) U.S. Cl. ..... 248/322; 40/40.5; 40/44; 248/327; 411/400; 411/401

(58) Field of Classification Search ..... 411/400, 411/401; 248/322, 323, 327, 328, 329, 339, 248/340; 47/40.5, 67, 44, 47, 43, 41.11, 47/46

See application file for complete search history.

(56) References Cited

U.S. PATENT DOCUMENTS

| | | | | |
|---|---|---|---|---|
| 1,544,642 | A | 7/1925 | Hughes | |
| 3,521,401 | A | 7/1970 | Shisler | |
| 3,739,525 | A | 6/1973 | Rybak | 47/44 |
| 4,254,579 | A | 3/1981 | Flynn | 47/46 |
| 4,562,662 | A | 1/1986 | Ten Pas | 47/43 |
| 4,964,602 | A * | 10/1990 | Reinhard | 248/217.4 |
| 4,968,541 | A | 11/1990 | McCrory | 428/9 |
| 5,059,077 | A * | 10/1991 | Schmid | 411/400 |
| 5,486,386 | A | 1/1996 | Rovsek | 428/18 |
| 5,690,457 | A * | 11/1997 | Smetz | 411/400 |
| 5,967,482 | A | 10/1999 | Holod, Jr. | 248/343 |
| 6,032,916 | A | 3/2000 | Holliday | 248/505 |
| 6,350,499 | B1 | 2/2002 | Babcock | 248/19 |
| 6,435,463 | B1 | 8/2002 | Zezza | 248/322 |
| 7,117,650 | B2 * | 10/2006 | Dockery | 52/506.07 |
| 2003/0062460 | A1 * | 4/2003 | Facey et al. | 248/328 |

* cited by examiner

*Primary Examiner*—Ramon O Ramirez
(74) *Attorney, Agent, or Firm*—Barlow, Josephs & Holmes, Ltd.

(57) ABSTRACT

A hanging assembly for suspending a decorative tree, such as a Christmas tree, from an overhead support and a method of suspending a decorative tree from an overhead support are provided. An anchor is installed into the overhead support structure. A suspension member extends downwardly from the anchor. A tree engaging member is attached to a structural member of the tree and is engaged to the lower end of the suspension member in a manner that facilitates easy positioning and adjustment of the suspension height of the tree. In this manner the tree is displayed in a structurally secure and balanced way virtually eliminating the possibility that the tree be overturned.

26 Claims, 6 Drawing Sheets

SYSTEM FOR SUSPENDING DECORATIVE TREES

CROSS-REFERENCE TO RELATED APPLICATIONS

This application is related to and claims priority from earlier filed U.S. Provisional Patent Application No. 60/655,056, filed Feb. 22, 2005, the contents of which are incorporated herein by reference.

BACKGROUND OF THE INVENTION

The present invention relates generally to a new arrangement for displaying a decorative tree such as a Christmas tree. More specifically, the present invention relates to a unique assembly that provides for hanging a Christmas tree for display in upright position while also including a variety of additional features that facilitate installing the tree in the desired position and allow for adjustment of the position of the tree as necessary.

Generally, Christmas tree stands such as are typically found in the prior art are well known. They are formed to include a wide stand base to provide stability in order to hold the tree upright and include a means for gripping the base of the tree that is generally positioned centrally in the stand base. Due to the manner in which these stands support the tree in a vertical position, all of these prior art stands by their nature tend to be unstable to some extent. The instability is simply the result of the fact that the lever arm that the tree possesses will always be greater than the lever arm that the base stand possesses. Accordingly, anytime a force is exerted against the tree, the force is likely to be sufficient to result in overturning the tree. Additionally, prior art stands also suffer from the shortfall of being unable to adequately support a tree that has a trunk that is substantially off center or that is not substantially straight. In such cases, should the center of gravity of the tree lie close to the edge of or outside the radius of the base of the tree stand, the tree may be highly unstable or even impossible to stand upright.

There are a number of Christmas tree stands that attempt to deal with the above problem and generally take the form of a two-part stand that includes some form of swivel that receives the trunk of the tree, which is in turn received in a stand base. The swivel is installed onto and grips the base of the tree trunk. The tree with the swivel attached is then placed into a lockable receptor in the base stand and with the tree oriented vertically the receptor and swivel are secured to one another. One such prior art stand includes a cup-shaped holder that can be inclined relative to a vertical orientation to permit proper positioning of the tree thereby compensating for irregularities in the tree shape. Additionally another such stand includes a hemispherical ball that is received and retained by two adjustable jaws. Finally, another such stand includes three adjustable length legs to straighten the tree.

The difficulty with all of these prior art stands is that in the context of the overall problem stated above, that is the large mechanical advantage which the tree has over any of these stands, a base type stand solution will always be flawed. In view of this inherent problem, other prior art solutions have been directed towards suspending the decorative tree from above. In general these systems include a hook assembly that is installed into the ceiling, a tree engaging member that is installed onto or around the tree trunk and a strap that extends between the tree engaging member and the hook thereby suspending the tree. Some of these devices utilize a mesh type tube that engages the top of the tree, however this is quite unsightly. Another option provides for engaging the tree utilizing straps that are configured similar to wire ties. The difficulty here is that these devices do not allow readjustment of the tree once installed and require that the user support the weight of the tree when suspending it.

In view of the shortcomings in the prior art solutions, there is a need for a means for hanging a Christmas tree for display that is convenient, adjustable and easy to use while providing a secure support for maintaining the tree in an upright position.

BRIEF SUMMARY OF THE INVENTION

In this regard, the present invention provides a hanging assembly for suspending a decorative tree, such as a Christmas tree, from an overhead support. In this manner, the present invention provides for a structurally secure and balanced way for a Christmas tree to be displayed while virtually eliminating the possibility that the tree be overturned.

The assembly of the present invention includes generally an anchoring device that is installed into an overhead support and includes a hook or concealed anchor from which to hang the assembly. A hanging cable extends downwardly from the hook or concealed anchor wherein the hanging cable is preferably a heavy gauge monofilament or light gauge wire cable that is discrete and difficult to see when installed. In one embodiment, a hook is attached to the end of the hanging cable. In this configuration a strap is provided that is wrapped around and engaged with the trunk of the tree. The strap is provided with a plurality of spaced apart holes that are provided to receive the hook and serve to support the tree while also facilitating adjustment of the tree simply by placing the hook into a different hole. Alternately, the strap may be replaced with a bar that includes a series of pins thereon. In this case the bar is engaged along the trunk of the tree and the hook is received around the desired pin to support the tree. In yet another embodiment of the present invention, a pulley (or pulleys) is installed onto the end of the hanging cable and a double purchase rope is engaged around the tree placed over the pulley and extended back to a cleating assembly. This provides the user with a mechanical advantage when moving and positioning the tree in the hanging position while also allowing easy adjustment of the height of the tree as necessary.

In addition the hanging assembly may be provided in a kit that also includes a plumb line device and/or a stud finder for assisting in locating the anchor member in the correct location, an assembly for anchoring the bottom end of the tree to prevent displacement of the tree once it has been hung and a container into which the trunk of the tree is placed to facilitate watering of the tree.

Accordingly, it is an object of the present invention to provide an assembly for easily supporting a decorative tree in a manner that facilitates easy installation and adjustment of the tree. It is a further object of the present invention to provide a hanging assembly for a decorative tree that is discreet and not easily seen once the tree has been installed. It is yet a further object of the present invention to provide an assembly for hanging a decorative tree that provides the user with a mechanical advantage when installing and adjusting the position of the tree.

These together with other objects of the invention, along with various features of novelty, which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
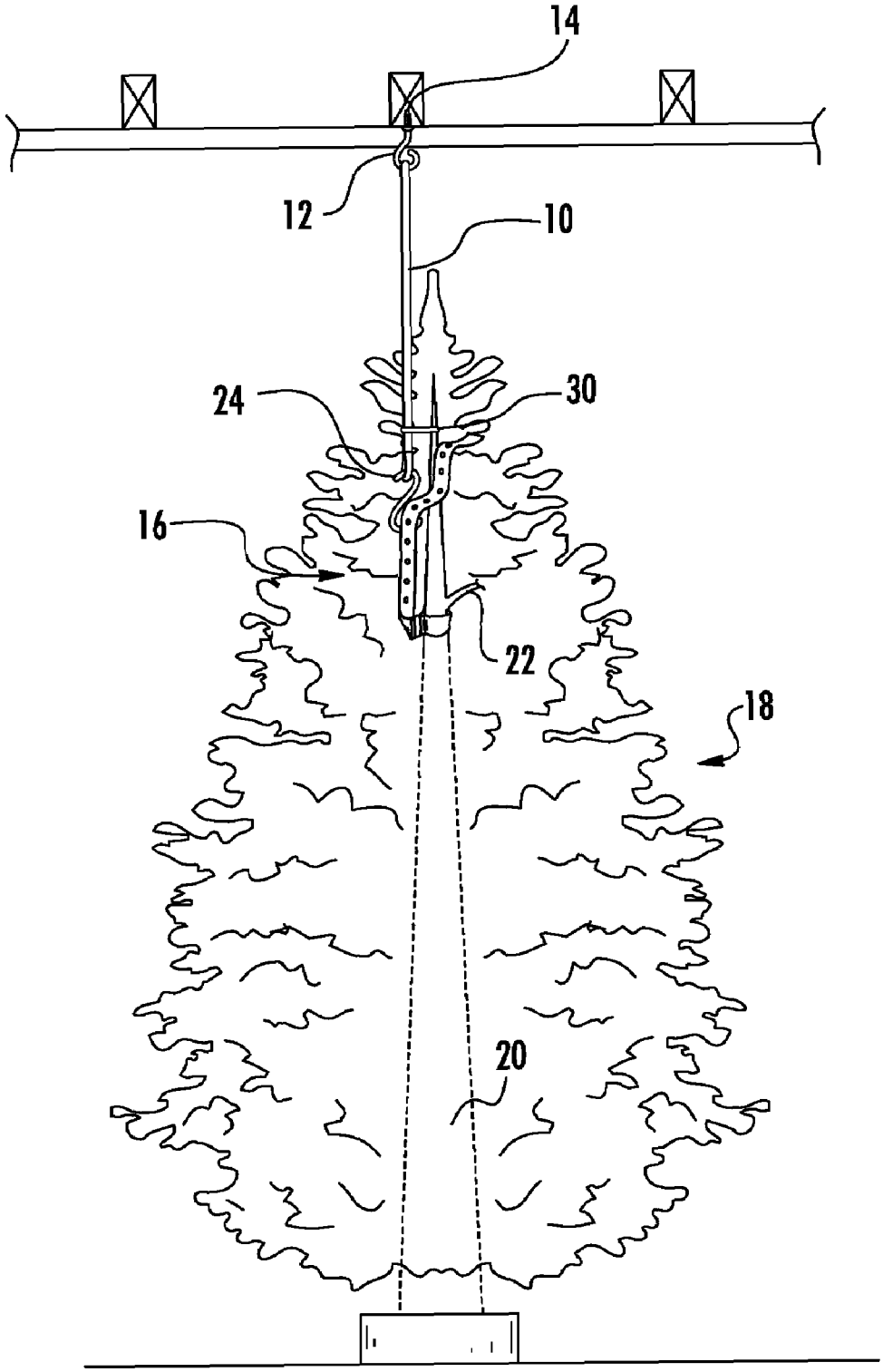
FIG. 1 is a front view of a first embodiment of the decorative tree hanging system of the present invention.

Now referring to the drawings, the hanging assembly for suspending a decorative tree is shown and generally illustrated in the figures. Referring to FIG. 1, as can be seen the hanging assembly includes a suspension member 10, an anchor 12 that is installed into the overhead structure 14, and a tree engaging member 16 that engages the tree 18. The first end of the suspension member 10 attaches to the anchor 12 and the second end of the suspension member 10 engages the tree engaging member 16 thereby suspending the tree 18 from the overhead structure 14 in a manner that is inherently dynamically stable thereby virtually eliminating the possibility that the tree 18 be overturned.

In the context of the present invention, is should be appreciated by one skilled in the art that the term decorative tree 18 is not intended to be limiting with regard to the particular type of tree 18. For example, one possible type of tree 18 that would fall within the scope of the meaning intended by the term decorative tree would be a Christmas tree. Further, such a tree 18 could be a real cut tree, a real balled tree or an artificial tree. Any type of decorative tree 18 is intended to fall within the scope of the present invention. In any case, the tree 18 includes a plurality of structural members that support and provide the shape of the tree. In a real tree 18 the structural members are the trunk 20 and tree branches 22 that extend outwardly from the trunk 20. In an artificial tree, the structural members are the central support and the rigid rod or wires that are shaped to represent branches.

To support the hanging assembly of the present invention, including the decorative tree 18 to be suspended, an anchoring device 12 is provided. The anchoring device 12 preferably includes a first end capable of engaging the overhead support 14 and a second configured to engage and retain the suspension member as will be described in more detail below. Preferably, this anchor 12 is a threaded device that has an open hook on one end and has a threaded shank that is configured to engage a structural overhead support 14 such as a joist, wood structural member, suspended ceiling support, masonry, etc. located in the ceiling where the anchor 12 is to be installed. Alternatively, various other suitable masonry anchors or drywall type anchors may be utilized provided they develop sufficient strength to support the assembly and the weight of the tree 18. The anchor 12 could also take the form of an eyebolt and still fall within the scope of the present invention.

Figure 6:
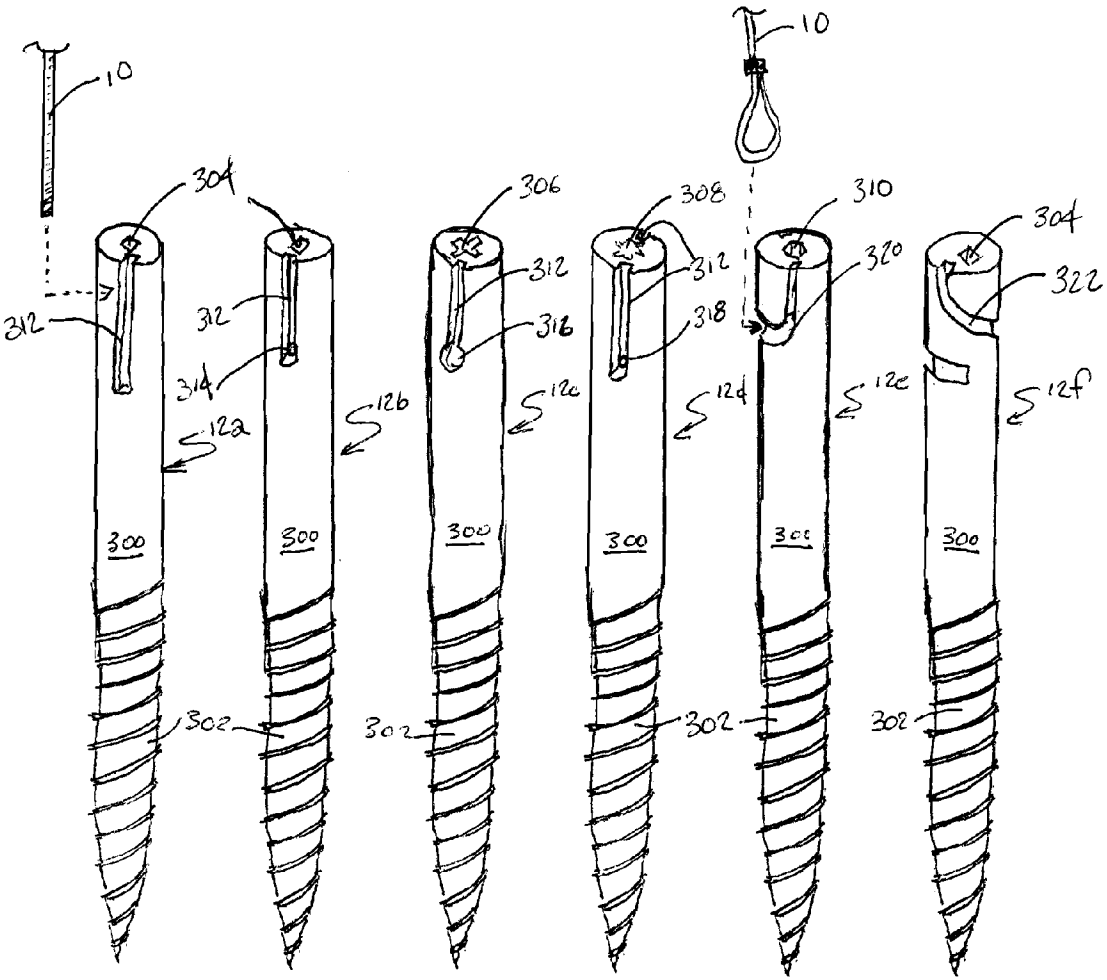
FIG. 6 illustrates a plurality of concealed anchor configurations for use in conjunction with the present invention.

Turning to FIG. 6, a number of alternate anchors 12*a*-12*f* are illustrated. In particular, these anchors 12*a*-12*f* are configured to provide a ceiling anchor wherein the installation is nearly invisible. In principal, each of the alternate anchors are formed as a single shaft that has a distal end which is threaded and configured to engage a structural overhead support 14 as described above. To facilitate installation of the anchors 12*a*-12*f*, the proximate end of the shaft 300 is formed to include an aperture to facilitate driving the anchor 12*a*-12*f* using convention driver drill technology. Specifically, the proximate end of the shaft 300 is formed to include a square drive aperture 304, a Phillips drive aperture 306, a Torx drive aperture 308, an hex drive aperture 310 or any other suitable small format drive known in the art.

Each of these anchors 12*a*-12*f* is formed to receive and engage the upper end of the suspension member 10. Anchor 12*a* includes a simple groove 312 formed in the side that is configured to receive the upper end of the suspension member and frictionally retain it. Similarly anchor 12*b* includes the same groove 312 but provides a hole 314 at the terminal end of the groove 312 into which the terminal end of the support member 10 is placed to further enhance the ability of the anchor 12*b* in retaining the upper end of the support member 10. Anchor 12*c* also includes a groove 312 that terminates in an enlarged aperture 316. The enlarged aperture allows for a swedge, knot or other device to be installed onto the end of the terminal end of the support member 10 preventing the support member 10 from being withdrawn from the groove 312 once the assembly is placed in its installed position. Anchor 12*d* includes a groove 312 on two opposing sides of the anchor 12*d*. A hole 318 extends through the shaft 300 of the anchor 12*d* and thereby allows the upper terminal end of the support member 10 to extend down one of the grooves 312, through the hole 318 and back along the groove 312 on the opposing side in the shaft 300 providing additional security in retaining the terminal end of the support member 10. In anchor 12*e*, a lateral groove 320 is shown. This allows for the terminal end of the support member 10 to be formed into a loop and received within the lateral groove 320. Finally, anchor 12*f* provides a groove 322 that spirals around the upper portion of the shaft 300 into which the terminal end of the support member 10 is placed and frictionally retained.

Figure 7:
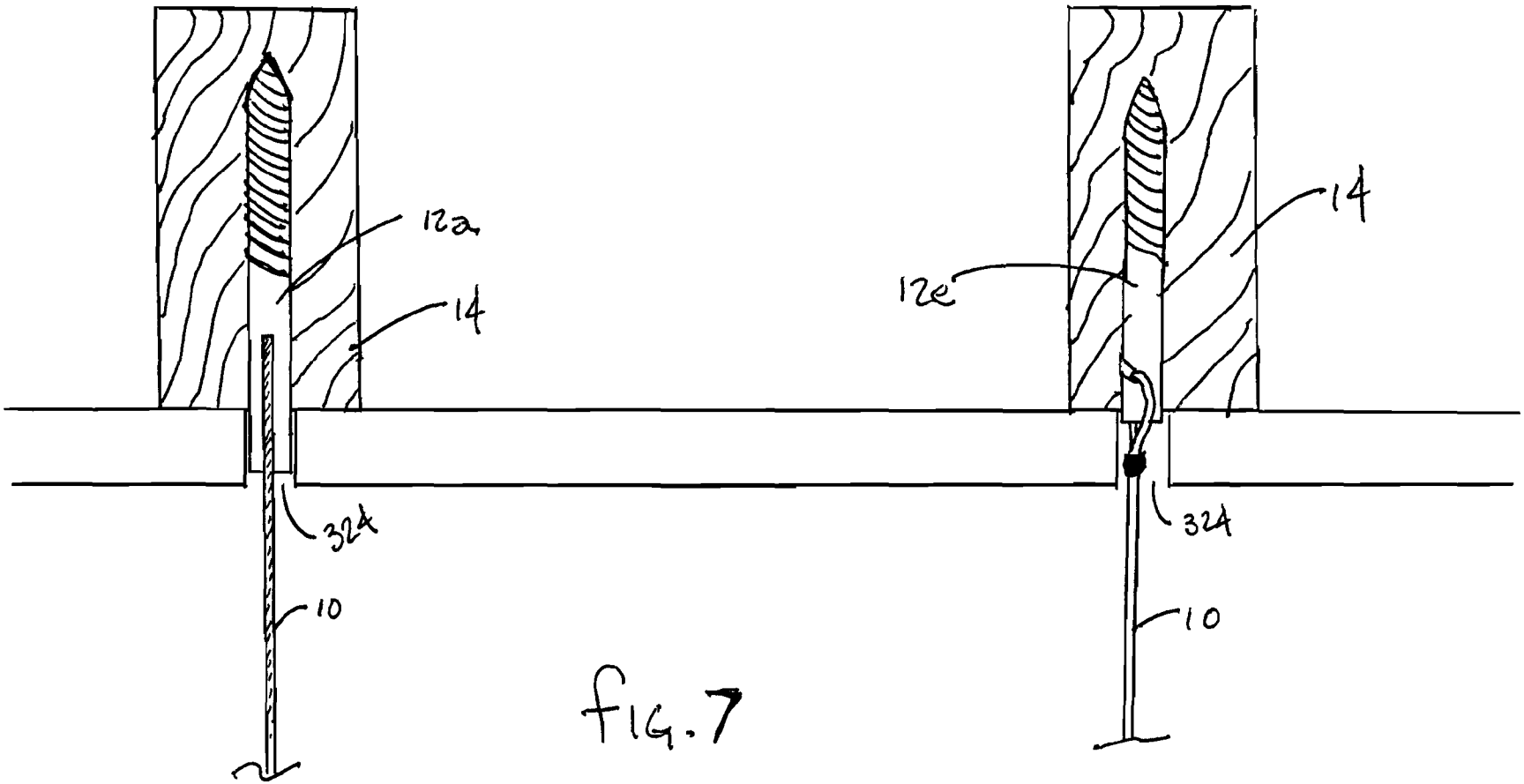
FIG. 7 is a cross-sectional view of two embodiments of the anchors of FIG. 6 shown installed into a supporting structure.

In each of the anchor embodiments 12*a*-12*f* that were illustrated in FIG. 6, it is important to note that the principal purpose of the anchor 12*a*-12*f* is to facilitate a concealed installation. In this regard, the anchor 12*a*-12*f* is formed using a headless configuration so that the anchor 12*a*-12*f* can be installed by recessing the proximate end of the shaft 300 into the hole that is created by the installation of the anchor 12*a*-12*f* itself. Accordingly, the concealed anchor 12*a*-12*f* is installed by partially driving the anchor 12*a*-12*f* into the ceiling structure in the desired location. Placing the terminal end of the support member 10 into the receiving portion of the anchor 12*a*-12*f* and completely driving the anchor 12*a*-12*f* until it is fully recessed into the support structure. In this manner, the support structure cooperates with the receiving structure provided on the anchor 12*a*-12*f* to trap and retain the terminal end of the support member 10. FIG. 7 depicts two anchors 12*a* and 12*e* as they would appear once fully installed. The only element that is visible below the support structure 14 is the support member 10 itself. Further the relationship between the support structure 14, the anchor 12*a*, 12*e* and the support member 10 can be clearly seen, wherein the support structure 14 serves to trap the support member 10 into the receiving structure on the anchor 12*a*, 12*e*. To further conceal the installation, a user could simply fill the hole 324 made by the shaft 300 of the anchor with putty, spackle or the like. It should also be appreciated that while six different anchor 12*a*-12*f* embodiments are depicted, these anchors 12*a*-12*f* are meant only to illustrate a few of the possible configurations that may be used to receive the terminal end of the support member 10. On skilled in the art can appreciate that many other possibilities exist that would still fall within the scope of the present disclosure.

In order to position the anchor 12 in the desired and structurally suitable location the hanging assembly of the present invention may be provided in the form of a kit that may also include a plumb line as is well known in the art, so that a vertical plumb line can be used to transfer the desired floor location of the tree up onto the ceiling. Further, a stud finder device may be provided to assist the user in location wood structure into which the anchor 12 can be installed. Additionally, to assist in installation of the anchor 12, the kit may include a drill bit suitable for drilling a pilot hole thereby allowing the anchor 12 to more easily be connected to the overhead support structure 14.

In contrast to many of the prior art devices, the present invention provides both a suspension member 10 and an adjustable tree engaging member 16. The suspension member 10 is preferably heavy-duty monofilament. Similarly, wire, cable, coated wire, string, twine, braided nylon or rope may also be utilized and still fall within the scope of the invention. The ends of the suspension member 10 may be terminated in any manner known in the art and may be formed to include a hook 24 as shown, any other suitable hook or simply as a loop suitable for engagement between the various components of the present invention while all of the suitable structures are not disclosed or described herein with particularity, there are a large number of open hooks, closed hooks, ferrules, and operable hooks that are well known in the art and would suitable for an interface between the suspension member and the other components of the present invention. The benefit to providing such a suspension member 10 in accordance with the teachings of the present invention is that the suspension member 10 is preferably of a thin gauge material and more preferably a transparent thin gauge material that allows the suspension member 10 to be installed without having a great deal of visual weight or impact. This gives the illusion that the tree 18 is supported in a traditional manner and not supported from overhead by a bulky and visually unattractive assembly.

Figure 2:
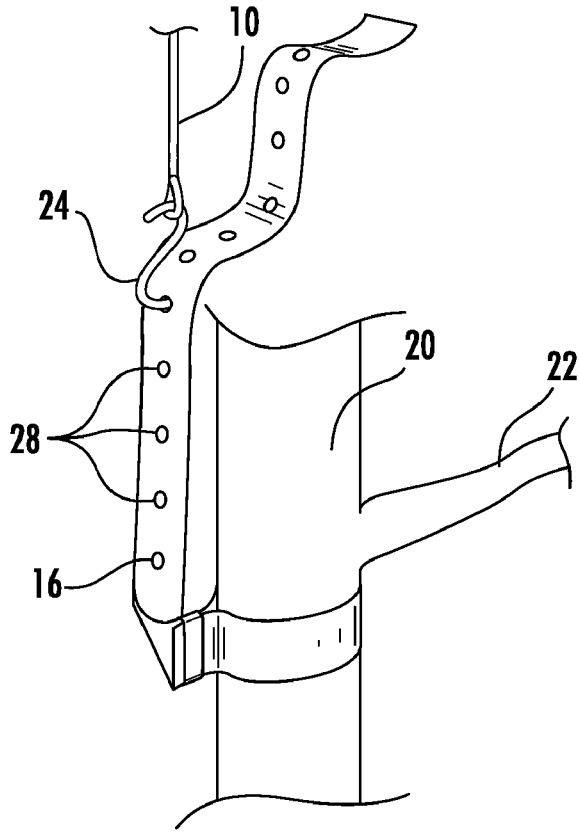
FIG. 2 is a detail view of the tree engaging strap of the first embodiment.

Now turning back to FIGS. 2, 3 and 4, one of the main components of the tree hanging assembly of the present invention, the tree engaging member 16, is illustrated in the form of several alternative embodiments. In general, the tree engaging member 16 is configured to engage the tree 18 and provide a point of interface for further attachment to the suspension member 10. In the first embodiment depicted in FIG. 2, the tree engaging member 16 is a flexible strap with a loop on one end thereof. The loop may be formed in the flexible strap itself or may be a D-ring that is attached to the end of the strap. The strap is wrapped around the trunk 20 of the tree 18 and the free end is passed through the loop or the D-ring to firmly engage the trunk 20 of the tree 18. Preferably the strap is wrapped around the trunk 20 of the tree 18 at a point just below a major branch 22 structure to allow the strap to support the weight of the tree 18 without sliding up the trunk 20 of the tree 18. The free end of the strap includes plurality of spaced apart grommet holes 28 to allow a hook 24 to be engaged at the desired height as will be further described below.

Figure 3:
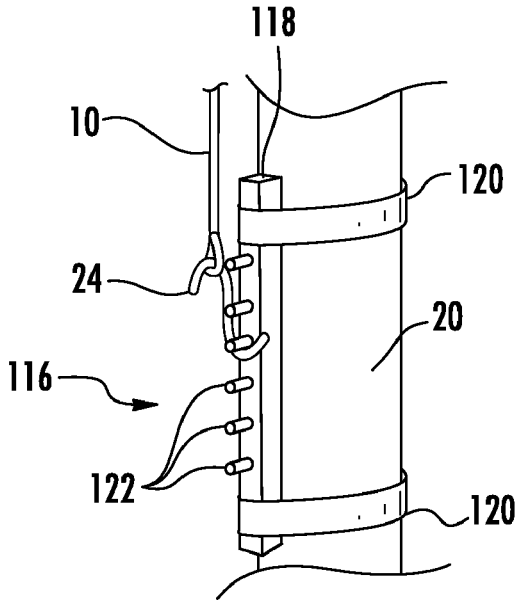
FIG. 3 is a detail view of an alternate embodiment of a tree engaging strap.

Turning to FIG. 3, an alternate embodiment tree engaging member 116 is illustrated. In this embodiment, a solid brace 118 is provided that is attached to the tree 18 trunk 20 at two points. The solid brace 118 is formed to include an elongate member having a first end and a second end. Straps 120 are disposed at the ends of the elongate member 118 wherein the straps 120 are configured to fasten the elongate member 118 to at least one of the structural members 20, 22 of said tree 18. In this case, hook and loop fastener straps are utilized to engage the brace 118 to the tree trunk. A plurality of spaced apart pegs 122 or other detents are provided that extend outwardly from the elongate member 118 of the brace for engagement with the suspension member 10 for supporting the tree. In this embodiment, the tree engaging member 116 is positioned against the tree 18 trunk 20 and the straps 120 are wrapped around and securely fastened to the trunk 20. The pegs 122 may extend outwardly at a slight downward angle to facilitate engagement of the lower end of the suspension member 10. Similarly the pegs 120 may also alternately be angled to the right and left to provide clearance for engagement with the lower end of the suspension member 10.

Figure 4:
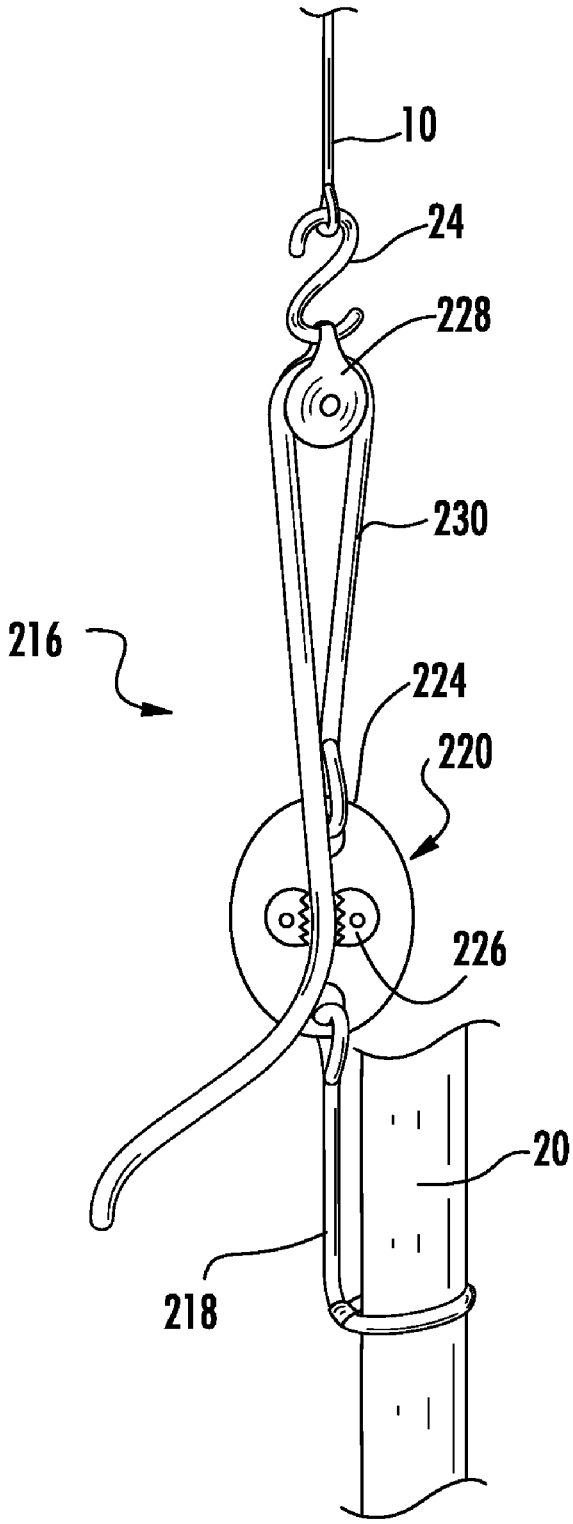
FIG. 4 is a detail view of another alternate embodiment hanging system.
Figure 5:
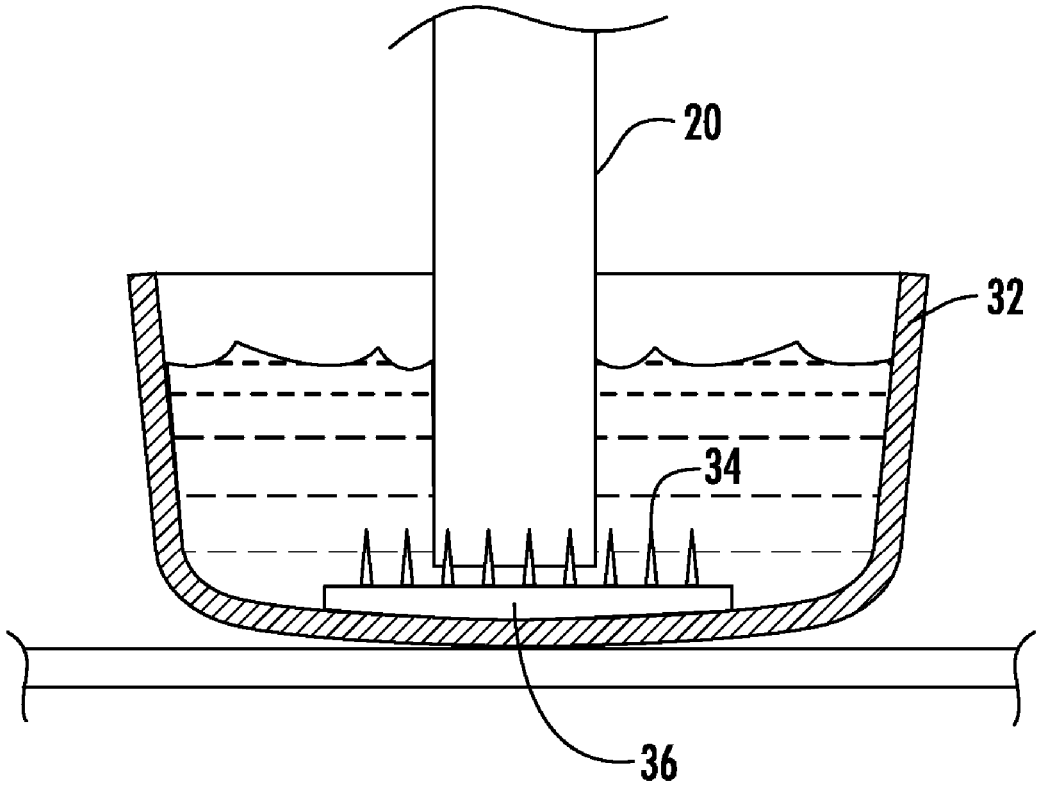
FIG. 5 is a detail view of the tree bottom support.

FIG. 4 illustrates yet another alternative embodiment of the tree engaging member 216 of the present invention. In this embodiment, the tree engaging member 216 includes a strap 218 having a first end configured to wrap around and engage at least one of the structural members 20, 22 of the tree 18. A second free end of the strap 218 extends outwardly and upwardly to engage with a locking mechanism 220 that includes an attachment point 224 and a releasable cleat assembly 226 thereon. The cleat 226 can be any type jam cleat or cam-cleating mechanism known in the art for belaying the free end of a line as will be described in detail below. Further, a pulley 228 is provided that is attached to the second end of the suspension member 10. A cord 230 is provided that is attached to and extends from the attachment point 224 in the cleat assembly 220, upwardly through the pulley 228 on the lower end of the suspension member 10 and back the cleat 226 on the cleat assembly 220. In this manner, the height of the suspended tree 18 can be easily adjusted by tightening the cord 230 and engaging the free end of the cord 230 in the cleat 226. Further, by providing a double purchase, the user is given a mechanical advantage of 2:1 over the weight of the tree 18 when pulling on the free end of the cord 230.

It can be seen that in any of the above described embodiments, the interface between the lower end of the suspension member 10 and the tree engaging member 16 facilitates a hanging assembly that is easily adjustable thereby allowing the height of the suspended tree 18 to be controlled as desired by the user. Once any one of the tree engaging members 16, 116, 216 is attached to the tree 18, the tree 18 is ready for engagement with the lower end of the suspension member 10. As was stated above, the lower end of the suspension member 10 may be formed as a loop that is directly engaged with the pins 122 on the second embodiment tree engaging member 116. Further, a hook 24 may be utilized to facilitate attachment of the lower end of the suspension member 10 with either the pulley 228 of the third embodiment tree engaging member 216 or the holes 28 provided in the first embodiment tree engaging member 16.

When the strap style tree engaging member 16 is utilized, a hook 24 interface will be provided to engage the grommet holes 28 in the strap. When a hook 24 is utilized, it is preferred that the hook 24 has a configuration and properties that allow easy release and removal of the hook 24 even when the hook 24 is under load. Similarly, when the elongage tree engaging member 116 is utilized, the ends of the suspension member 10 preferably will be formed as a loop or an open hook that is simply positioned beneath the desired peg 122 to transfer the load from the tree 18 into the suspension member 10.

To further facilitate installation of the tree 18, a spacer block may be utilized beneath the tree as it is positioned and installed. The spacer block is placed on the floor and the trunk 20 of the tree 18 is placed onto the spacer block as the tree 18 is brought into a vertical position. The spacer block assists in lifting the tree 18 so that the installer does not have to lift the tree 18 when attempting to connect it with the suspension member 10. Further, the spacer block lifts the tree 18 sufficiently such that once the tree 18 is placed in the hanging position and the spacer block is removed, as the suspension member 10 stretches, substantially all of the weight of the tree 18 is supported from above. To lend additional stability, straps 30 having hook and loop fasteners are provided that may be wrapped around the tree trunk 20 and the suspension member 10 thereby engaging the upper portion of the tree 18 with the suspension member 10. In this manner the tree 18 will hang more vertically relative to the suspension member 10 and be less likely to tilt.

To further stabilize the tree 18 and facilitate watering of the tree 18 in the case of suspending a live tree 18, a base support 32 in the form of a bucket may be provided for placement under the cut end of the tree 18. The bucket may also include raised protrusions 34 from the bottom thereof to serve as stand-offs that prevent the tree 18 from sitting directly on the bottom of the bucket. The protrusions 34 may extend from an insert 36 that is placed into the bucket or preferably may be molded integrally with the bottom of the bucket. The bucket may include a cover that has a cut out arrangement so that the cover can be reinstalled after the tree trunk 20 is installed and the bucket is filled with water. Also, the bucket may include a secondary cover structure that serves to enclose and contain the entire kit for storage when not in use.

The present invention is also directed to a method for suspending a decorative tree 18 from an overhead support 14 including the installation of an anchor member 12 into the overhead supporting structure 14. The suspension member 10 is then attached to the anchor 12 allowing a second end to hang downwardly from the anchor 12. The tree engaging member 16 is then installed onto at least one structural member 20, 22 of the tree 18. With the tree engaging member 16 installed, the tree 18 is lifted into an upright position and the tree engaging member 16 is connected to the lower end of the suspension member 10. The suspension height of the tree 10 can then be varied by adjusting the selective engagement between the lower end of the suspension member 10 and the tree engaging member 16 as described in detail above.

It can therefore be seen that the present invention provides a novel and easy to use hanging assembly for suspending a decorative tree from an overhead structural support. The method and assembly of the present invention provides unique functionality that makes the assembly less visible and makes installation and adjustment of the relative height of the tree quite simple as compared to the systems provided in the prior art. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A hanging assembly for suspending a decorative tree from an overhead support, wherein said decorative tree includes a plurality of structural members, the system comprising:

a suspension member having a first end and a second end;

an anchor having a first and a second end, said first end capable of engaging said overhead support, said second configured to engage and retain said first end of said suspension member;

a tree engaging member, said tree engaging member including:

a strap configured to wrap around and engage at least one of said structural members; and a plurality of spaced apart holes in said strap, said holes configured to receive and engage a hook positioned at said second end of said suspension member, wherein the relative height at which said tree is suspended can be varied by adjusting said selective engagement between said second end of said support member and said tree engaging member.

2. The hanging assembly of claim 1, wherein said suspension member is selected from the group consisting of: monofilament, wire, cable, coated wire, string, twine, braided nylon or rope.

3. The hanging assembly of claim 1, further comprising a basin, wherein said basin stabilizes a base of said decorative tree and provides a water storage space.

4. A hanging assembly for suspending a decorative tree from an overhead support, wherein said decorative tree includes a plurality of structural members, the system comprising:

a suspension member having a first end and a second end;

an anchor having a first and a second end, said first end capable of engaging said overhead support, said second configured to engage and retain said first end of said suspension member;

a tree engaging member, said tree engaging member including:

an elongate member having a first end and a second end;

straps disposed at said first and second ends of said elongate member configured to fasten said elongate member to said at least one structural member of said tree; and a plurality of pegs extending outwardly from said elongate member, said pegs configured to receive and engage said second end of said suspension member, wherein the relative height at which said tree is suspended can be varied by adjusting said selective engagement between said second end of said support member and said tree engaging member.

5. The hanging assembly of claim 4, wherein said suspension member is selected from the group consisting of: monofilament, wire, cable, coated wire, string, twine, braided nylon or rope.

6. The hanging assembly of claim 4, further comprising a basin, wherein said basin stabilizes a base of said decorative tree and provides a water storage space.

7. A hanging assembly for suspending a decorative tree from an overhead support, wherein said decorative tree includes a plurality of structural members, the system comprising:

a suspension member having a first end and a second end;

an anchor having a first and a second end, said first end capable of engaging said overhead support, said second configured to engage and retain said first end of said suspension member;

a tree engaging member, said tree engaging member including:

a strap having a first end and a second end, said first end configured to wrap around and engage at least one of said structural members;

a locking mechanism attached to said second end of said strap, said locking mechanism having an attachment point and a releasable cleat thereon;

a pulley attached to said second end of said suspension member; and a cord extending from said attachment point through said pulley and back to said cleat, whereby the height of the suspended tree can be adjusted by tightening said cord and engaging said cord in said cleat, wherein the relative height at which said tree is suspended can be varied by adjusting said selective engagement between said second end of said support member and said tree engaging member.

8. The hanging assembly of claim 7, wherein said suspension member is selected from the group consisting of: monofilament, wire, cable, coated wire, string, twine, braided nylon or rope.

9. The hanging assembly of claim 7, further comprising a basin, wherein said basin stabilizes a base of said decorative tree and provides a water storage space.

10. A method of suspending a decorative tree from an overhead support, wherein said decorative tree includes a plurality of structural members, the method comprising:

installing an anchor member into said overhead support;

attaching a first end of a suspension member to said anchor member, said suspension member having a second end opposite said first end;

engaging at least one structural member of said tree with a tree engaging member, said tree engaging member including, a strap configured to wrap around and engage at least one of said structural members; and a plurality of spaced apart holes in said strap, said holes configured to receive and engage a hook positioned at said second end of said suspension member;

lifting said tree into an upright position; and attaching said engaging member to said second end of said suspension member thereby suspending said tree, wherein the relative height at which said tree is suspended can be varied by adjusting said selective engagement between said second end of said support member and said tree engaging member.

11. The method of claim 10, wherein said suspension member is selected from the group consisting of: monofilament, wire, cable, coated wire, string, twine, braided nylon or rope.

12. The method of claim 10, further comprising a basin, wherein said basin stabilizes a base of said decorative tree and provides a water storage space.

13. A method of suspending a decorative tree from an overhead support, wherein said decorative tree includes a plurality of structural members, the method comprising:

installing an anchor member into said overhead support;

attaching a first end of a suspension member to said anchor member, said suspension member having a second end opposite said first end;

engaging at least one structural member of said tree with a tree engaging member, said tree engaging member including, an elongate member having a first end and a second end; straps disposed at said first and second ends of said elongate member configured to fasten said elongate member to said at least one structural member of said tree; and a plurality of pegs extending outwardly from said elongate member, said pegs configured to receive and engage said second end of said suspension member;

lifting said tree into an upright position; and attaching said engaging member to said second end of said suspension member thereby suspending said tree, wherein the relative height at which said tree is suspended can be varied by adjusting said selective engagement between said second end of said support member and said tree engaging member.

14. The method of claim 13, further comprising a basin, wherein said basin stabilizes a base of said decorative tree and provides a water storage space.

15. The method of claim 13, wherein said suspension member is selected from the group consisting of: monofilament, wire, cable, coated wire, string, twine, braided nylon or rope.

16. A method of suspending a decorative tree from an overhead support, wherein said decorative tree includes a plurality of structural members, the method comprising:

installing an anchor member into said overhead support;

attaching a first end of a suspension member to said anchor member, said suspension member having a second end opposite said first end;

engaging at least one structural member of said tree with a tree engaging member, said tree engaging member including, a strap having a first end and a second end, said first end configured to wrap around and engage at least one of said structural members; a locking mechanism attached to said second end of said strap, said locking mechanism having an attachment point and a releasable cleat thereon; a pulley attached to said second end of said suspension member; and a cord extending from said attachment point through said pulley and back to said cleat, whereby the height of the suspended tree can be adjusted by tightening said cord and engaging said cord in said cleat;

lifting said tree into an upright position; and attaching said engaging member to said second end of said suspension member thereby suspending said tree, wherein the relative height at which said tree is suspended can be varied by adjusting said selective engagement between said second end of said support member and said tree engaging member.

17. The method of claim 16, wherein said suspension member is selected from the group consisting of: monofilament, wire, cable, coated wire, string, twine, braided nylon or rope.

18. The method of claim 16, further comprising a basin, wherein said basin stabilizes a base of said decorative tree and provides a water storage space.

19. An anchor system for suspending objects from a support structure, said anchor system comprising:

an elongate suspension member having a first end and a second end, said second end opposite said first end; and an anchor member, said anchor member including, a shaft extending between a distal end and a proximate end, at least a portion of said shaft adjacent said distal end being threaded, a portion of said shaft adjacent said proximate end having a side wall extending longitudinally along said shaft, said side wall including a receiving structure formed therein for frictionally receiving and retaining said first end of said suspension member, and said proximate end including an aperture formed therein for driving said anchor into said support structure, wherein said second end of said suspension member extends outwardly from said support structure to receive and support said object.

20. The anchor system of claim 19, wherein said suspension member is selected from the group consisting of: monofilament, wire, cable, coated wire, string, twine, braided nylon or rope.

21. The anchor system of claim 19, wherein said anchor member is fully concealed within said support structure after installation.

22. The anchor system of claim 19, wherein said aperture for driving said anchor is configured to receive a driver bit selected from the group consisting of: square, Phillips, Torx and hex.

23. The anchor system of claim 19, wherein said first groove terminates in a hole that extends inwardly into said shaft, said hole receiving a terminal end of said first end of said suspension member.

24. The anchor system of claim 19, further comprising a second groove extending longitudinally along said proximate end of said shaft opposite said first groove, wherein said first groove terminates in a hole that extends through said shaft and into a terminal end of said second groove, wherein a terminal end of said first end of said suspension member is passed through said hole and extends at least partially into said second groove.

25. The anchor system of claim 19, wherein said first groove extends in a spiral around said sidewall of said shaft.

26. An anchor system for suspending objects from a support structure, said anchor system comprising:

an elongate suspension member having a first end and a second end, said second end opposite said first end; and an anchor member, said anchor member including, a shaft extending between a distal end and a proximate end, at least a portion of said shaft adjacent said distal end being threaded, a portion of said shaft adjacent said proximate end including a receiving structure, wherein said receiving structure is a groove extending laterally across said shaft adjacent said proximate end, wherein said first end of said suspension member is formed as a loop, said loop being received and retained by said groove and said proximate end including an aperture formed therein for driving said anchor into said support structure, wherein said second end of said suspension member extends outwardly from said support structure to receive and support said object.

* * * * *